United States Patent [19]

Josemans et al.

[11] 3,988,558

[45] Oct. 26, 1976

[54] TOGGLE SWITCH HAVING AN EASILY ASSEMBLED, ANTI-ROTATION MOUNTING MEANS FOR ITS PIVOTAL TOGGLE LEVER

[75] Inventors: Leonardus J. Josemans; James V. Johnson, Jr., both of Smithfield, N.C.

[73] Assignee: Cutler-Hammer, Inc., Milwaukee, Wis.

[22] Filed: May 28, 1975

[21] Appl. No.: 581,645

[52] U.S. Cl. ..... 200/335; 403/122; 74/473 P; 200/339

[51] Int. Cl.[2] ..... H01H 3/06

[58] Field of Search ..... 74/471 R, 473, 477, 74/491, 520; 200/329, 335, 296, 339, 153 G, 301; 403/114, 122, 123, 135, 140

[56] References Cited

UNITED STATES PATENTS

| | | | |
|---|---|---|---|
| 2,726,105 | 12/1955 | Koenig | 403/114 |
| 2,759,075 | 8/1956 | Hults | 200/168 |
| 3,482,465 | 1/1968 | Lusted | 74/473 |
| 3,722,931 | 3/1973 | Uchida | 430/140 |

*Primary Examiner*—Gerald P. Tolin
*Attorney, Agent, or Firm*—Hugh R. Rather; William A. Autio; Michael E. Taken

[57] ABSTRACT

A toggle lever for operating an electric switch and easily assembled, anti-rotation means for mounting the lever for limited pivotal movement within the mounting bushing of the switch. The toggle lever has an intermediate enlarged spherical portion including two short trunnions extending in opposite directions therefrom. The mounting means comprises a pair of interlocking semi-cylindrical molded insert halves having on their inner surfaces an annular socket for the spherical portion and each having a central hole to journal the corresponding trunnion when the two halves are placed therearound to form a subassembly. The cylindrical outer surface of these molded insert halves has a first part of detent means such as circumferentially arranged tapered protuberances that "cam" down through the bore in the bushing and engage a complementary part of such detent means such as an annular groove within the bushing into which these protuberances snap in when the subassembly is pressed down thereinto thereby to mount the toggle lever for limited pivotal movement on its trunnions while the inserts close the space around its spherical portion in the bore and frictionally adhere to the bushing with an interference fit to keep the toggle lever from turning on its axis. Other anti-rotation detent means are disclosed.

14 Claims, 6 Drawing Figures

TOGGLE SWITCH HAVING AN EASILY ASSEMBLED, ANTI-ROTATION MOUNTING MEANS FOR ITS PIVOTAL TOGGLE LEVER

BACKGROUND OF THE INVENTION

Means for pivotally supporting the intermediate spherical portion or ball of a toggle lever within the cylindrical bushing or collar of a toggle switch housing have been known heretofore. One widely used means has been a pivot pin that extends through holes in both the bushing and the ball. Another known means has been a constriction of the bore in the bushing forming an upper seat for the ball and against which it is held from below either by spring bias, a snap ring or other retainer while being confined to pivotal movement in one plane by an elongated slot or the like guiding the lower end of the lever. Alternatively, such constriction has provided the lower seat for the ball to be held thereagainst by a cap, insert or other retainer at the upper end of the bushing. Still another known expedient has been to use a resilient sleeve or socket of rubber, polyurethane or the like that can be stretched enough to snap over the ball and that can be squeezed enough to be held in the bushing either by a flange and groove, retainer, pressure or the like. While these prior structures have been useful for their intended purposes, nevertheless they are complex and costly to make and assemble. Thus, it is desirable to provide a toggle lever and mounting means that are simple and economical to manufacture and assembly and strong and efficient to use.

SUMMARY OF THE INVENTION

An object of the invention is to provide an improved toggle switch.

A more specific object of the invention is to provide a toggle switch with an improved toggle lever.

Another specific object of the invention is to provide a toggle switch with an improved toggle lever mounting means.

Another specific object of the invention is to provide a toggle switch with an improved toggle lever and improved easily assembled means mounting the same in a bushing.

Another specific object of the invention is to provide improved means affording easy, simple and economical assembly of the toggle lever into the bushing of a switch for limited pivotal movement therein and held against rotation on its longitudinal axis.

Other objects and advantages of the invention will hereinafter appear.

DESCRIPTION OF THE PREFERRED EMBODIMENT

Figure 1:
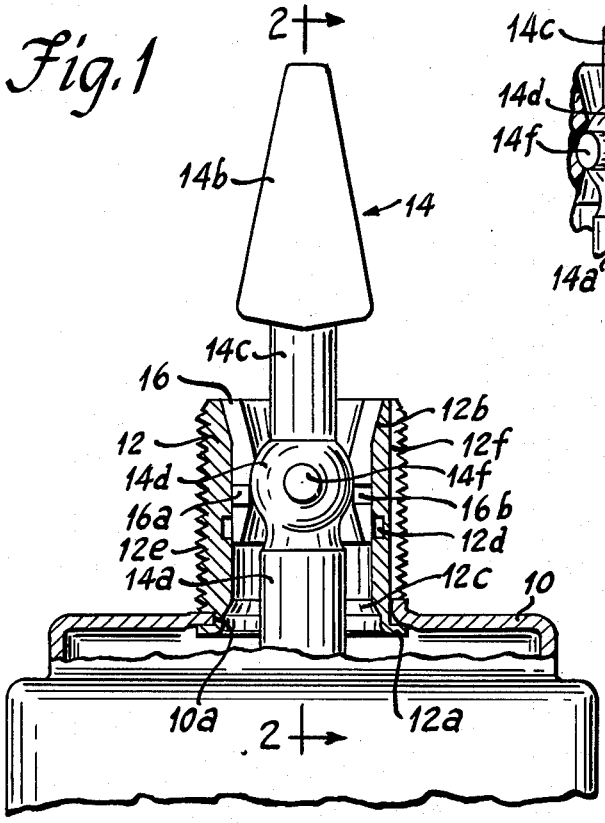
FIG. 1 is an enlarged vertical cross-sectional view of the upper portion of a toggle switch taken along line 1—1 of FIG. 2 to show the toggle lever and its easily assembled, antirotation mounting means.

Referring to FIG. 1, there is shown a toggle switch constructed in accordance with the invention. As shown therein, this switch comprises a frame 10 that is secured to and closes the open top of an insulating housing or base (not shown) that encloses the switch contact mechanism. This switch contact mechanism may take any one of the well known forms, as for example, that disclosed in H. W. Hults U.S. Pat. No. 2,759,075, dated Aug. 14, 1956, and owned by the Assignee of this invention.

Figure 2:
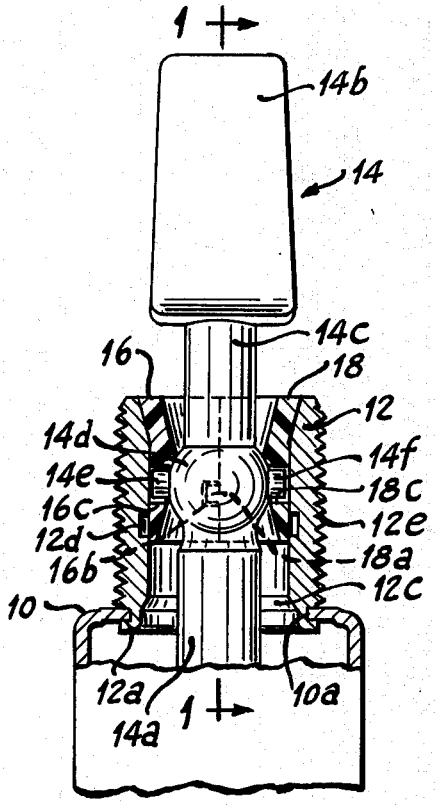
FIG. 2 is a vertical cross-sectional view taken along line 2—2 of FIG. 1 to show a transverse view of the toggle lever and its mounting means.
Figure 4:
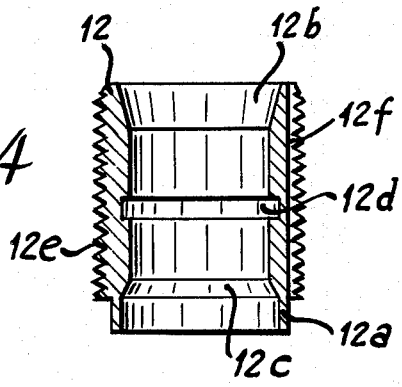
FIG. 4 is a cross-sectional view of the bushing of FIGS. 1 and 2 showing the interior surface thereof including the annular groove therein.

This switch also comprises a bushing 12 secured in a center hole **10*a* in the top of frame 10. As shown in FIG. 4, this bushing is provided with a reduced-thickness lower end section 12*a* that fits snugly through the hole and is radially swaged below the rim of the hole in the frame to rigidly secure the bushing to the frame as shown in FIGS. 1 and 2. The upper end of the cylindrical bore in the bushing is flared out about 16 degrees to provide a bevel 12*b* to facilitate entry of the inserts hereinafter described. The lower end of this bore is flared out to provide a bevel 12*c* to afford clearance for the lower end portion 14*a* of a toggle lever 14 when it is pivoted in opposite directions as hereinafter described. The inner surface of this bushing is also provided with a recess such as an annular groove 12*d* shown in FIG. 4 suitably located between the upper and lower bevels to receive snap-in protuberances or detents hereinafter described. In addition, this bushing is provided with external threads 12*e* and a vertical keyway 12*f*** along one side whereby the switch is non-rotatably mounted in a hole in a panel with the addition of a washer and nut, not shown, to secure it therein. While the aforedescribed frame and bushing may be made of metal such as steel and brass, respectively, as separate pieces and then swaged together, it will be apparent that they can alternatively be molded as a single piece from plastic molding material.

The aforementioned toggle lever 14 is a one-piece member molded of plastic insulating material such as "Valox" or "Zytel 101", or the like, as shown in FIGS. 1 and 2. This lever has a designed handle portion **14*b* at its upper end extending above the upper end of the bushing for gripping by the hand of the user. Directly below this handle portion, a reduced round portion 14*c* extends into the bushing. A ball or spherical portion 14*d* connects this reduced round portion 14*c* to the aforementioned lower end portion 14*a* that is also round but slightly larger in diameter than portion 14*c*. Two round trunnions 14*e* and 14*f* extend in opposite directions from ball 14*d* on a common axis that also passes through the center of the ball, the toggle lever being pivoted by these trunnions. As shown in FIG. 2, the distance between the outer ends of these trunnions is slightly less than the diameter of the bore in the bushing thereby allowing insertion of the toggle lever into the bushing as hereinafter described. Lower end portion 14*a* of the toggle lever is provided with suitable means, such as shown in the aforementioned H. W. Hults patent, for actuating the movable contact or contacts within the switch housing in response to pivotal movement of handle portion 14***b* to the right or left as seen in FIG. 1. While a one-piece toggle lever has been shown, it could be made of two or more pieces connected together including use of different colored caps thereon.

This switch is provided with snap-in means for pivotally supporting the toggle lever by its trunnions in the bushing. This means comprises a pair of like, semi-circular or generally semi-cylindrical inserts 16 and 18 molded of plastic insulating material such as nylon, zytel 101 or the like, shown in FIG. 2, which together embrace the ball of the toggle lever. These two inserts interlock with one another at their abutting edges by projection 16*a* of insert 16 fitting into notch 18*b* of insert 18 and projection 18*a* of insert 18 fitting into notch 16*b* of insert 16. This interlocking retains the inserts in longitudinal registration with one another both during and after assembly into the bore of the bushing.

Figure 3:
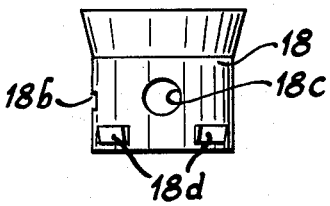
FIG. 3 is an outside elevational view of one of the two, like mounting inserts used in the toggle switch of FIGS. 1 and 2 showing the tapered detents thereon.

FIG. 3 shows the outer surface of insert 18. Each of these inserts is provided with a generally semi-cylindrical outer surface extending up from its lower end closely to fit the bore in the bushing and terminating in a diverging or flared upper end complementary to bevel 12*b* in the upper end of the bushing bore. Each insert is provided with a radial bore 16*c*, 18*c* located substantially centrally of its semi-cylindrical outer surface as shown in FIG. 3 for receiving the corresponding trunnion of the toggle lever. The bore formed by placing the two inserts in abutting engagement is beveled out at both the top and bottom as shown in FIGS. 1 and 2 to provide clearance for swinging the toggle lever in opposite directions while trunnions 14*e* and 14*f* spin in holes 16*c* and 18*c*. The inserts afford an interference fit inside the bushing. As they expand after being forced into the bushing, the outer walls of the inserts tend to grip the inner walls of the bushing and provide an anti-rotation feature that orients the paddle-like or other design of lever. Other means for preventing rotation of the toggle lever are apparent.

Figure 5:
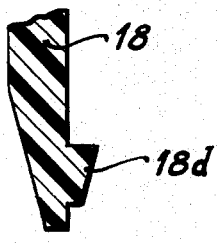
FIG. 5 is a cross-sectional view through one of the snap-in detents of the insert shown in FIG. 3.

Insert 18 is provided with a pair of angularly spaced apart protuberances or detents 18*d* on a common circumference adjacent the lower end of its semi-cylindrical outer surface as shown in FIG. 3. Insert 16 has a pair of similar detents integrally formed therewith. The outer surface of each such detent tapers or slants down and inwardly about 15° from vertical as shown in cross-section in FIG. 5 so that the four detents of the two inserts assembled on the trunnions can be inserted freely at least partway into the bevel at the top of the bushing bore, whereafter the subassembly is forced down into the bore until the detents snap into annular groove 12*d* within the bushing. Under this condition, the upper, flared end of the pair of abutting inserts becomes flush with the top of the bushing to provide a smooth and neat appearance.

Alternatively, detents 18*d* could be semi-spherical or semi-cylindrical in shape so that the rounded surface thereof cams down within the bushing and catches into annular groove 12*d*. Drilled holes or recesses could be used in place of annular groove 12*d*.

Figure 6:
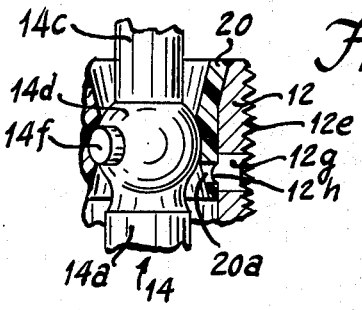
FIG. 6 is a fragmentary cross-sectional view showing a modification of the detent means that retains the inserts within the bushing.

A modification of the detent means is shown in FIG. 6. In place of protuberances 18*d*, each insert such as 20 has rectangular holes 20*a* molded therein. After the two inserts and toggle lever have been placed within the bushing, a shearing and forming operation is performed. In this operation, a pair of spaced apart vertical slits are cut opposite each such rectangular hole and the strip 12*g* formed thereby is bumped inwardly. This forms a protuberance 12*h* that extends partly into such rectangular hole to secure the inserts within the bushing.

From the foregoing, it will be apparent that this one-piece toggle lever and snap-in pivotal mounting means provides a structure that is simple and economical to manufacture, having fewer parts, and easy to assemble quickly, thus reducing the cost of manufacture while retaining the required structural features.

While the apparatus hereinbefore described is effectively adapted to fulfill the objects stated, it is to be understood that this invention is not intended to be confined to the particular preferred embodiments disclosed, inasmuch as they are susceptible of various modifications without departing from the scope of the appended claims.

We claim:

1. The combination of:

a pivotal actuating lever having a handle portion at one end, an actuating portion at its other end, and a pivotal portion therebetween, said pivotal portion having a pair of trunnions that extend in opposite directions;

a mounting member having a generally cylindrical bore;

easily assembled anti-rotation mounting means for said actuating lever comprising a pair of inserts embracing said pivotal portion of said lever, said inserts having holes for said trunnions and clearance allowing limited pivotal movement of said lever when said inserts and lever are inserted into said bore with an interference fit thereby to mount said actuating lever for limited pivotal movement in said mounting member;

and detent means retaining said inserts and lever within said bore.

2. The combination of claim 1, wherein:

said pivotal portion is enlarged and substantially spherical and said trunnions extend from opposite sides thereof on a common axis through the center of said spherical portion.

3. The combination of claim 1, wherein:

the distance between the ends of said trunnions is slightly less than the diameter of said bore in said mounting member.

4. The combination of claim 1, wherein:

said bore in said mounting member has a diverging bevel at one end to facilitate insertion thereinto said toggle lever with said inserts held therearound.

5. The combination of claim 4, wherein:

said inserts are semi-circular; and said detent means comprises a plurality of protuberances spaced around the circumference of said semi-circular inserts and having converging surfaces to facilitate insertion thereof into said bore.

6. The combination of claim 5, wherein:

the angle of said converging surfaces is substantially complementary to the angle of said bevel.

7. The combination of claim 6, wherein:

said detent means comprises an annular groove in the wall defining said bore;

and said protuberances are angularly spaced apart on a common circumference around the outer surface of said inserts.

8. The combination of claim 7, wherein:

said protuberances are adjacent the ends of said inserts first inserted into said bore.

9. The combination of claim 1, wherein:

said detent means comprises holes in said semi-circular inserts and portions of said mounting member slit and formed into said holes to retain said inserts and lever within said bore.

10. The combination of claim 1, wherein:

said detent means comprises a plurality of protuberances around said inserts and corresponding recesses within said bore for retaining and preventing rotation of said lever and inserts within said bore.

11. A toggle switch comprising:

a switch housing comprising an upstanding bushing having a bore therethrough and recess means in the wall of said bore;

a toggle lever extending through said bore and having an external handle portion at one end, an actuating portion at its other end extending into said switch housing, and an enlarged portion therebetween within said bore, said enlarged portion having a pair of trunnions that extend in opposite directions and the peripheral portions of said enlarged portion transverse to the axis of said trunnions being circular;

and easily assembled anti-rotation means mounting said toggle lever for limited pivotal movement in said bore comprising a pair of generally semi-cylindrical inserts embracing said enlarged portion and having opposite holes for said trunnions and detents on their outer surfaces that can be squeezed into said bore as said toggle lever and said inserts therearound are forced as a unit down from the top of said bushing until said detents stop in said recess means.

12. The toggle switch of claim 11, wherein:

said enlarged portion is a spherical portion integrally molded with said handle and actuating portions and said trunnions of plastic insulating material;

and said inserts have inner surfaces closely hugging said spherical portion to close completely the space around said toggle lever in said bore.

13. The toggle switch of claim 11, wherein:

said generally semi-cylindrical inserts comprise interlocking means at their abutting edges for locking them into longitudinal registration with one another.

14. The toggle switch of claim 12, wherein:

said inserts are provided on their inner surfaces with an annular socket for the spherical portion of said lever.

* * * * *